US006557180B2

(12) United States Patent
Hall McKenzie

(10) Patent No.: US 6,557,180 B2
(45) Date of Patent: May 6, 2003

(54) HAT WITH REVERSIBLE CROWN AND DETACHABLE, REVERSIBLE VISOR

(76) Inventor: Mona Hall McKenzie, 414 Branch Dr., Silver Spring, MD (US) 20901

( * ) Notice: Subject to any disclaimer, the term of this patent is extended or adjusted under 35 U.S.C. 154(b) by 0 days.

(21) Appl. No.: 09/836,917

(22) Filed: Apr. 18, 2001

(65) Prior Publication Data

US 2002/0000001 A1 Jan. 3, 2002

Related U.S. Application Data

(60) Provisional application No. 60/197,757, filed on Apr. 19, 2000, and provisional application No. 60/195,871, filed on Apr. 7, 2000.

(51) Int. Cl.[7] ..... A42B 1/00

(52) U.S. Cl. ..... 2/195.1; 2/207; 2/209.12

(58) Field of Search ..... 2/183, 209.11, 2/209.13, 175.1, 195.1, 195.2, 175.5, DIG. 2, 918

(56) References Cited

U.S. PATENT DOCUMENTS

| | | | | | |
|---|---|---|---|---|---|
| 911,126 | A | | 2/1909 | Harrison et al. | |
| 911,432 | A | | 2/1909 | Pachner | |
| 2,648,847 | A | | 8/1953 | Crowder | |
| 4,873,726 | A | | 10/1989 | Tapia | |
| 5,070,545 | A | | 12/1991 | Tapia | |
| 5,181,277 | A | | 1/1993 | Sherman | |
| 5,488,740 | A | | 2/1996 | Garza | |
| 5,553,325 | A | * | 9/1996 | Gutierrez | 2/171 |
| 5,613,246 | A | | 3/1997 | Alexander | |
| 5,862,523 | A | * | 1/1999 | Proctor | 2/209.11 |
| 5,893,170 | A | * | 4/1999 | Garza | 2/12 |
| 5,898,935 | A | | 5/1999 | Davis | |
| 6,070,270 | A | | 6/2000 | De La Torre | |
| 6,237,156 | B1 | * | 5/2001 | Ellman et al. | 2/195.1 |

* cited by examiner

*Primary Examiner*—John J. Calvert
*Assistant Examiner*—Katherine Moran

(57) ABSTRACT

A headwear assembly that includes a reversible crown, shaped to fit the head of a wearer with a prong buckle, fabric with hook and loop fasteners, fabric ties, plastic, one-size-fits-all or other size adjustment mechanisms, having first and second opposing major surfaces and a detachable and reversible single visor with first and second opposing major surfaces. A detachable and reversible dual visor with first and second opposing major surfaces can also be attached to the reversible crown. The reversible crown includes cooperating attachment members located on the inside non-focal surfaces of the first and second major opposing surfaces, providing the base for attaching, detaching and reattaching the removable and reversible single or dual visor. The detachable and reversible single visor has first and second major opposing surfaces along with cooperating attachment members to used to attach, detach and reattach itself to the reversible crown. The dual visor also has first and second major opposing surfaces with cooperating attachment members to attach, detach and reattach to the reversible crown. The visor and crown are easily removable and reversible to include one major surface each being displayed upwardly during wear and accounts for many different headwear assembly looks as well as having the reversible crown worn alone.

8 Claims, 7 Drawing Sheets

HAT WITH REVERSIBLE CROWN AND DETACHABLE, REVERSIBLE VISOR

CROSS-REFERENCE TO RELATED APPLICATIONS

This Application is entitled to the benefit of Provisional Patent Application Ser. No. 60/197,757 filed Apr. 19, 2000 and Ser. No. 60/195,871 Filed Apr. 07, 2000.

BACKGROUND—STATEMENT REGARDING FEDERALLY SPONSORED RESEARCH OR DEVELOPMENT

Not Applicable

REFERENCE TO MICROFICHE APPENDIX

Not Applicable

REFERENCE TO SEQUENCE LISTING, A TABLE, OR A COMPUTER PROGRAM LISTING APPENDIX

Not Applicable

BACKGROUND—FIELD OF THE INVENTION

This invention relates to headwear, specifically to an improved mechanism for achieving multiple headwear assembly appearances. Headwear has been utilized for thousands of years for protection from the sun and in more recent years, for fashion statements. Present day consumers are often looking for variety in and cost effectiveness of their selection of headwear, which has lead to many variations of the traditional baseball cap and other types of headwear., The present invention allows purchasers to utilize several different headwear assembly appearances with the purchase of only one headwear assembly, while still preserving the functionality of a headwear garment.

BACKGROUND—DESCRIPTION OF PRIOR ART

Traditional baseball caps and other types of traditional headwear were manufactured with one crown assembly, one visor, and one size adjustment mechanisms sewn together and utilized for protection (Harrison O'Brien—U.S. Pat. No. 911,126 and Pachner—U.S. Pat. No. 911,432 ). Previous patents have addressed the novelty issue of recent baseball caps by providing interchangeable insignia patches of sports team logos (Tapia—U.S. Pat. No. 4,873,726 and 5,070,545), as well as displaying a drawing of a human face with moveable parts (Crowder—U.S. Pat. No. 2,648,847) Many caps now have detachable components and are also used for decorative purposes, as highlighted by the following patents: Alexander's Cap with a Removable and Reversible Visor (U.S. Pat. No. 5,613,246), De La Torre's Three-in-one transformation hats, (U.S. Pat. No. 6,070,270), Sherman's Reversible Hat Assembly (U.S. Pat. No. 5,181,277), Garza's Reversible and Size Adjustable Hat (U.S. Pat. No. 5,488, 740) and Davis' Cap with Adjustable and Interchangeable Visor Attachments (U.S. Pat. No. 5,898,935).

The present invention overcomes limitations of prior art caps by providing a headwear assembly that includes both a reversible crown assembly and the choice of a single or dual detachable and reversible visor assembly, which is attached to said reversible crown assembly. The dual visor assembly, consisting of one large visor and one smaller connected to the said reversible crown assembly of a headwear assembly, allows the smaller visor the ability to be flipped up. This invention also overcomes limitations of prior art caps by providing four or more major surfaces via screenprinting, embroidery or another similar process for displaying logos, advertisement, sports team emblems or the like without the complexity of using an interchangeable method for displaying said insignias, and thus creating four or more headwear assemblies with one product purchase. In addition, this invention also allows for separate cleaning or replacement of said detachable and reversible single or dual visor assembly or said reversible crown assembly as well as purchase of additional headwear assemblies for mix and match at the wearer's discretion.

SUMMARY OF THE INVENTION

It is therefore an object of the invention to provide an improved headwear assembly that includes two reversible crown displays and two detachable and reversible single or dual visor displays that can be worn interchangeably to create multiple looks with one product purchase, and enhanced by purchasing additional said reversible single or dual visor assembly or said reversible crown assembly in order to mix and match.

It is another object of the invention to provide an improved headwear assembly which is readily modified to utilize various colors, fabrics and insignias on the two reversible crown displays and the two detachable and reversible single or dual visor displays, thus creating multiple looks with one product purchase and enhanced by purchasing additional visor or crown treatments in order to mix and match.

It is another object of the invention to provide an improved headwear assembly that is readily modified where the exposed crown side can be displayed with one of the two different single or dual visor sides and then the non-exposed crown side can be turned over to the prominent position and displayed with one of the two different single or dual visor sides. This process can be achieved via attachment mechanisms such as hook and loop fasteners, snaps or other attachment assemblies.

It is therefore an object of the invention to provide an improved headwear assembly that includes detachable and reversible single or dual visor assembly which is attached to the front portion of said reversible crown assembly with or without a prong buckle size adjuster in the back of the cap.

It is another object of the invention to provide an improved headwear assembly which is readily modified to utilize various colors, fabrics and insignias on said detachable and reversible single or dual visor assembly which is connected at the front portion of said reversible crown assembly, as well as on said reversible crown assembly, whether or not said detachable and reversible single or dual visor assembly is worn in the normal or flipped up position.

It is another object of the invention to provide an improved headwear assembly that is readily modified where the top visor of the dual visor assembly, which is attached to front portion of said reversible crown assembly, is turned to the flipped up position.

Finally, it is another object of the invention to provide an improved headwear assembly, which is comfortable to wear, looks similar to conventional headwear products, is assembled similarly to conventional headwear products, which allows for multiple looks with one product purchase and enhances manufacturing techniques and breathes even more creativity into the headwear industry.

Briefly described according to a preferred embodiment, the present invention consists of a headwear assembly, otherwise of a traditional design, with a reversible crown assembly and detachable and reversible single or dual visor assembly, using a method of detaching and reversing the crown and visor assemblies with hook and loop fasteners, snaps or another attachment mechanism, with or without size adjustment mechanisms in the posterior of the cap, to accommodate a variety of head sizes.

OBJECTS AND ADVANTAGES

Accordingly, several objects and advantages of my invention include:

(a) an innovative product which merchandises well in the retail sector and lends itself to commercial success;

(b) allows the invention to be used on different types of headwear such as baseball-style caps, sunvisors and kerchief, (c) the ability to utilize different garments increases marketability of the garments and increases sales of similar products such as reversible bags and reversible jackets;

(d) allows for definitive fashion statement while the consumer supports his/her favorite colors or insignias;

(e) said invention is easy to wear and easy to convert to another look;

(f) mirrors some traditional headwear garments yet revolutionizes the way traditional headwear garments will be worn;

(g) provides a cost effective garment for the consumer whereas he/she can obtain multiple fashion statements with one purchase at about the same cost of traditional headwear garments. Further objects and advantages of my invention will become evident from a consideration of the drawings and ensuing description.

BRIEF DESCRIPTION OF THE DRAWINGS

The features and advantages of the present invention are better understood when referencing the accompanying drawings, where the important elements are identified with a figure number and numeral reference point.

LIST OF REFERENCE NUMBERS

| | | |
|---|---|---|
| 10-Cap crown (side one) | 11-Cap crown (side two) | 13-Single Visor (side one) |
| 14-Single Visor (side two) | 15-Hook and Loop Fasteners | 16-Air Holes |
| 17-Size Adjusting Mechanism | 18-Fabric Covered Button | 19-Insignias |
| 21-Color (Blue) | 22-Color (Orange) | 23-Color (Yellow) |
| 24-Color (Green) | 32-Dual Visor (top) | 33-Dual Visor (bottom) |
| 34-Color (Red) | 35-Color (Purple) | 36-Cap crown (back) |
| 37-Fabric band | 38-Eyelet casing | 39-Prong buckle |
| 40-Sunvisor crown (side one) | 41-Sunvisor crown (side two) | 50-Kerchief crown (side one) |
| 51-Kerchief crown (side two) | | |

DESCRIPTION OF THE PREFERED EMBODIMENT

Figure 1:
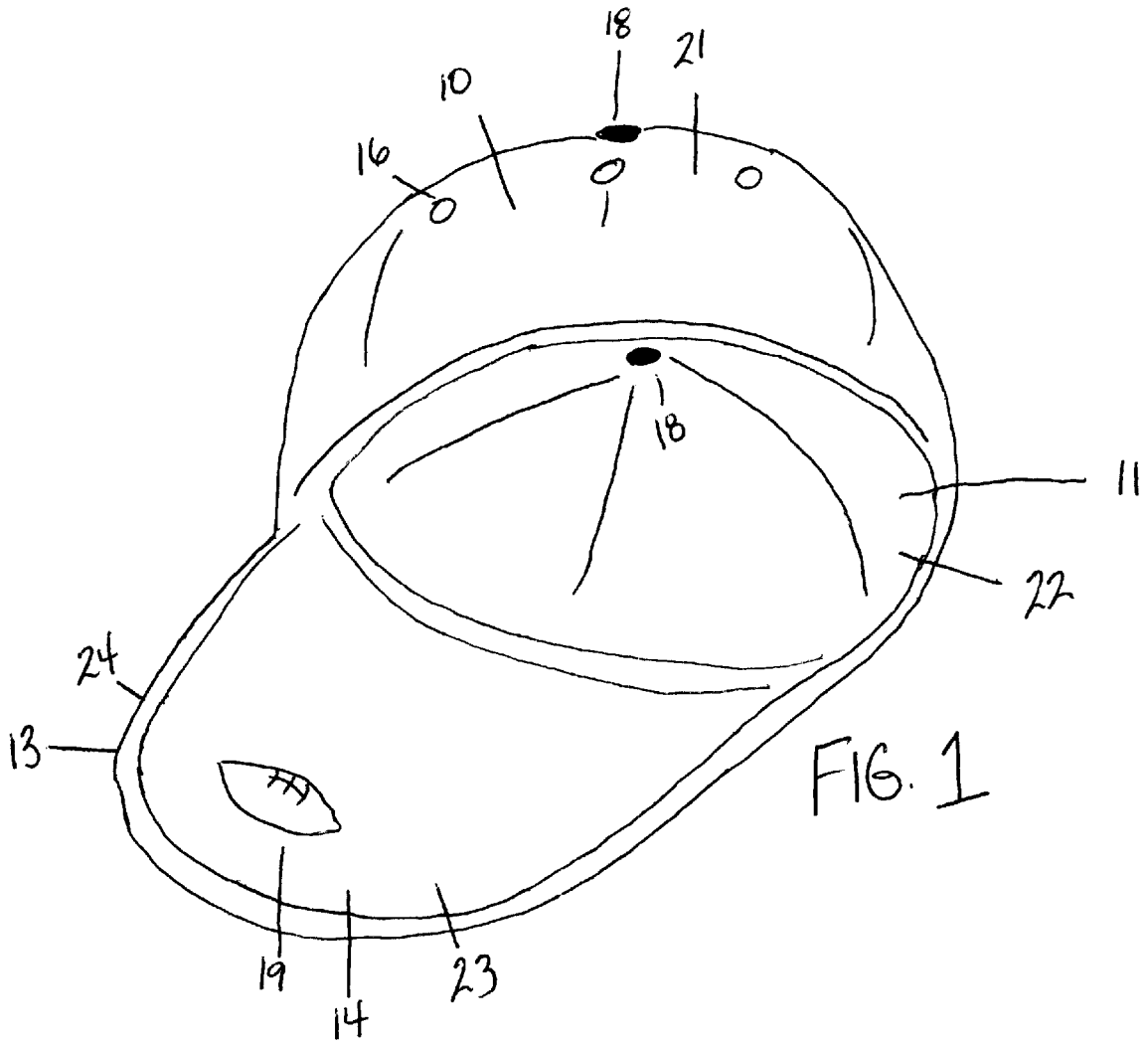
FIG. 1 is one wearable version, depicting the back view, underside of the cap, highlighting the exposed crown (blue) with the unexposed crown (orange), along with the exposed visor side (green) and the unexposed visor side (yellow), according to the preferred embodiment of the present invention.
Figure 10:
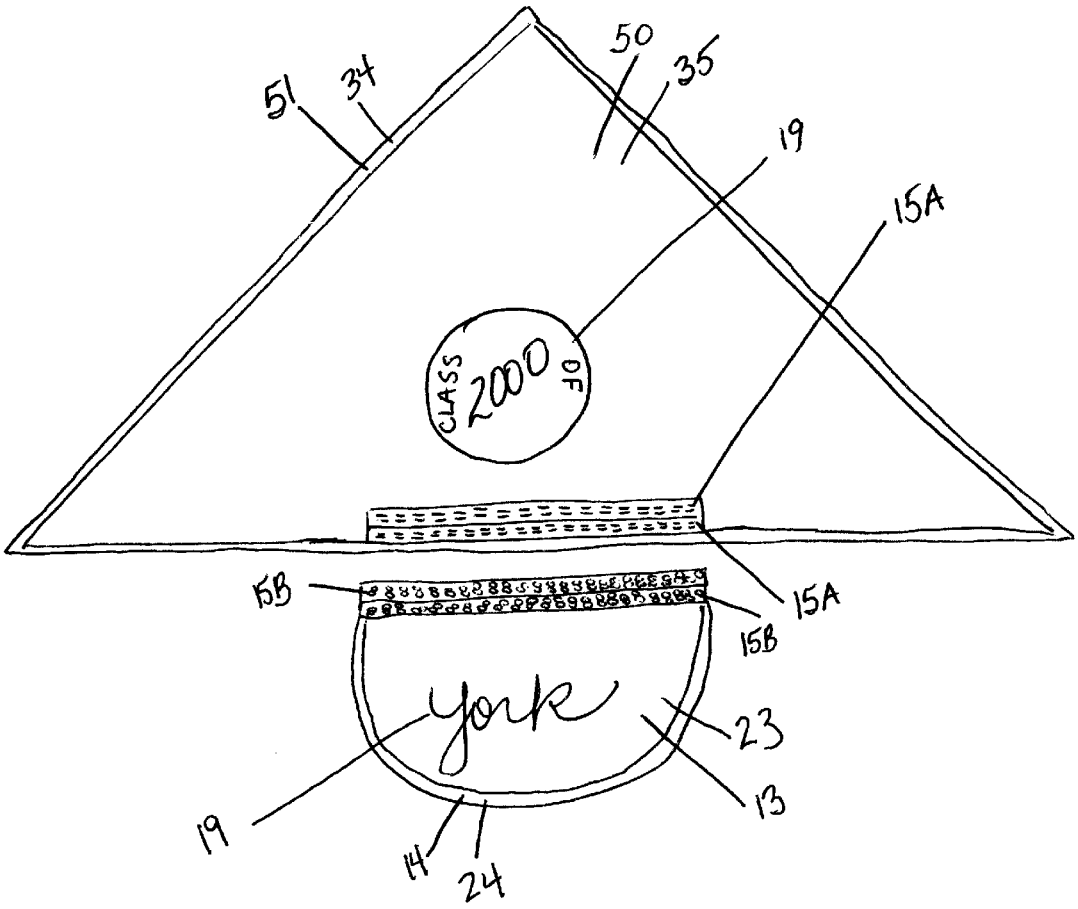
FIG. 10 is one wearable version, different from FIG. 1, which depicts how the visor connects to the crown of the kerchief, where the exposed visor and unexposed visor both have hidden hook and loop attachments and are connected to the exposed crown of the kerchief and unexposed crown of the kerchief with hidden hook and loop attachments, according to the preferred embodiment of the present invention.

Referring more specifically to the drawings, for illustrative purposes the present invention is generally shown in FIG. 1 though FIG. 10. It will be appreciated that the apparatus may vary as to configuration and as to details of the parts without departing from the basic concepts as disclosed herein.

Figure 3:
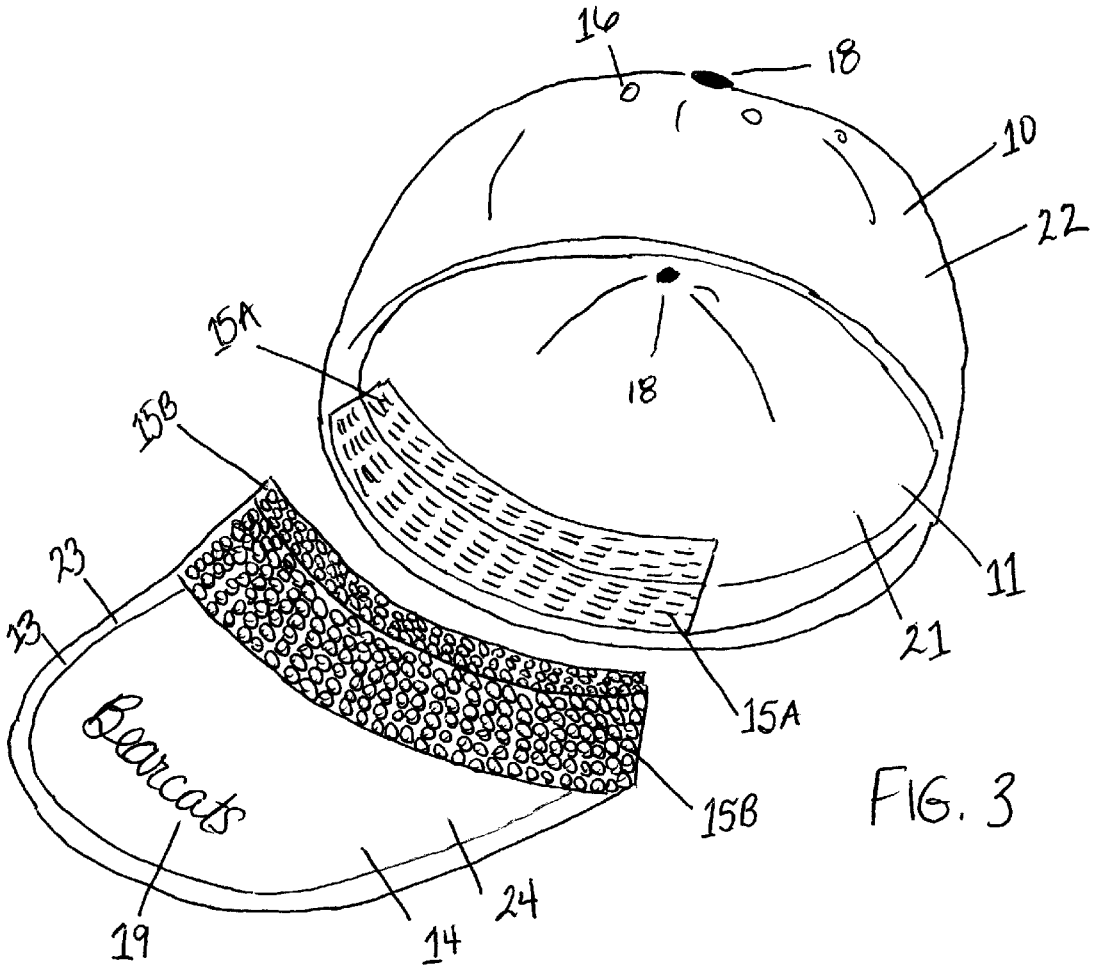
FIG. 3 is one wearable version, different from FIG. 1, whereas now the back view, underside of the cap depicts how the exposed visor (yellow) and the unexposed visor (green) were reversed from FIG. 1, and are connected to the exposed visor (orange) and the unexposed visor (blue), reversed from FIG. 1, with hidden hook and loop attachments, according to the preferred embodiment of the present invention.

A first embodiment of the headwear assembly illustrated in FIGS. 1 and 3 preferably resembles a traditional baseball-style cap, and includes a reversible crown 10 and 11 and a detachable, reversible single visor 13 and 14. A male-female mechanism of detaching the visor from the crown and subsequent reattachment of the visor to the crown is utilized, also allowing for the reversal of the crown and or visor assemblies. The crown has two major opposing surfaces 10 and 11, which includes different fabric colors or insignias. The single visor also has two major opposing surface 13 and 14, which allow for different fabric colors or insignias.

Figure 2:
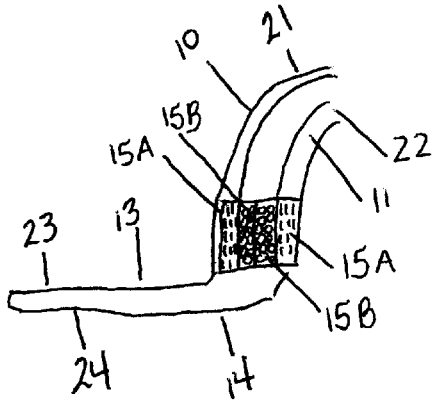
FIG. 2 is a view depicting how the visor connects to the crown of the cap, where the exposed visor (yellow) and unexposed visor (green) both have hidden hook and loop attachments and are connected to the exposed crown (blue) and unexposed crown (orange) with hidden hook and loop attachments, according to the preferred embodiment of the present invention.

As best shown in FIGS. 2–3, the detachable and reversible single visor assembly 13 and 14 includes an arcuate flange which extends upward and is formed along the inside of the first and second major surfaces. A hook and loop fastener assembly 15A and 15B is connected to the arcuate flange of the detachable and reversible visor assembly 13 and 14. The anterior portion of the crown assembly 10 and 11 has a section which is not sewn together, allowing for hook and loop fastener strips to be attached to the inside the two major opposing surfaces. This hidden attachment process allows the visor and crown assemblies to be detached, reversed and reassembled easily and efficiently, while maintaining the traditional look of the baseball-style cap.

To display an alternate surface of the preferred embodiment, the wearer must separate the crown from the opposing hook and loop fastener strips which attaches the first major crown surface from the first major visor surface. This action is repeated for the second major surfaces. At this point the wearer can choose to utilize the first major crown surface and the second major visor surface or any other combination of surfaces. After making the selection the hook and loop fastener system is utilized to reattach all the surfaces to again reflect the traditional baseball-style cap.

Figure 4:
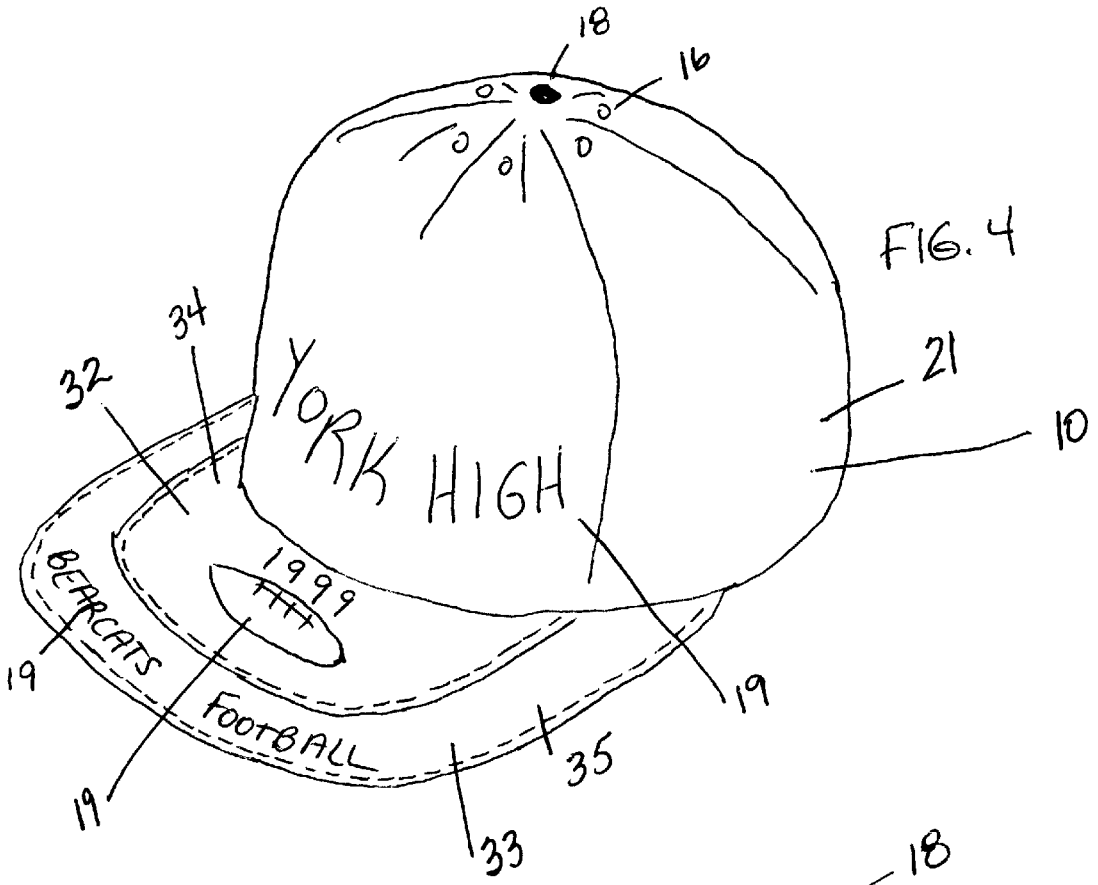
FIGS. 4&5 depict frontal and top views respectively of crown assemblies with dual visors.
Figure 5:
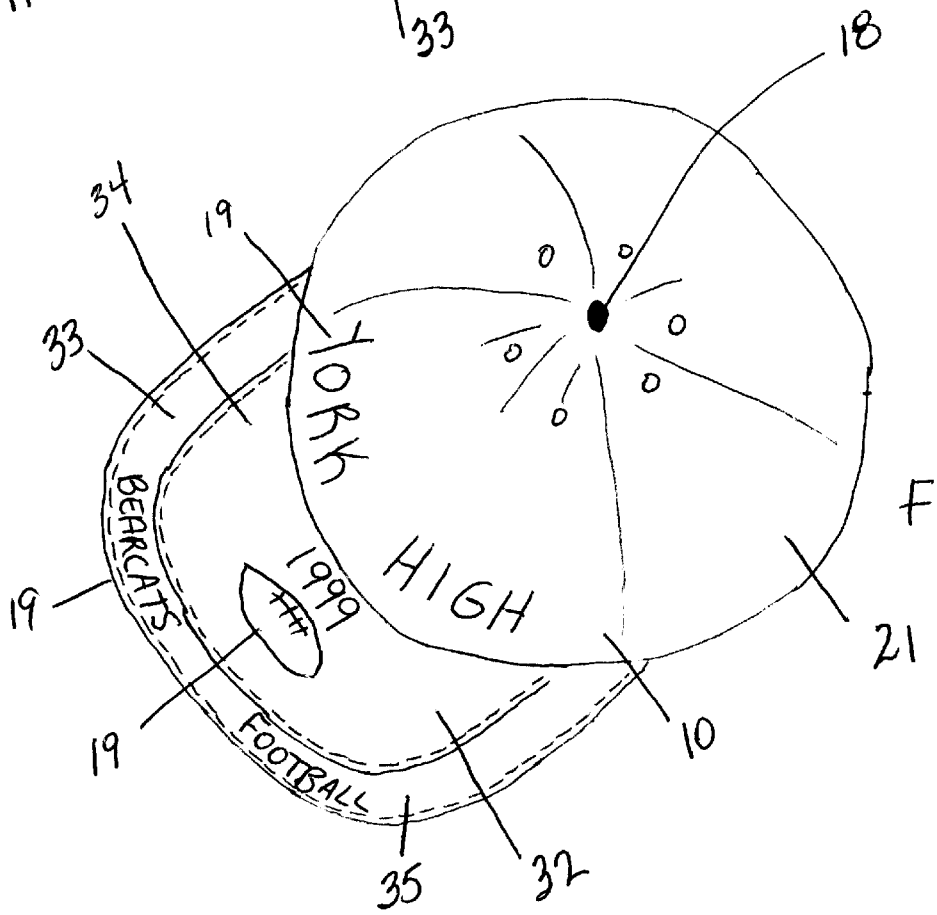
Figure 6:
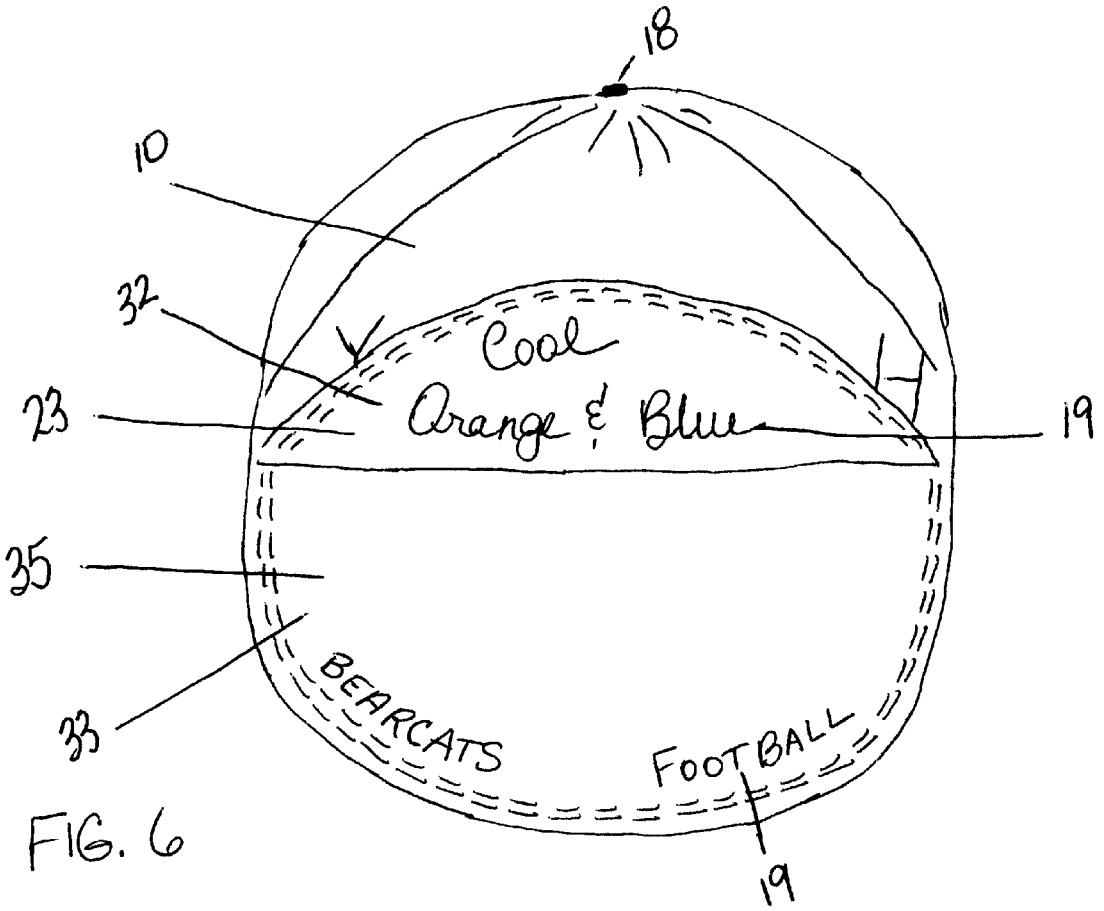
FIG. 6 depicts a frontal view of a crown assembly with a dual visor in the flipped up position. In this position, you are able to see yet another visor color and insignia.
Figure 7:
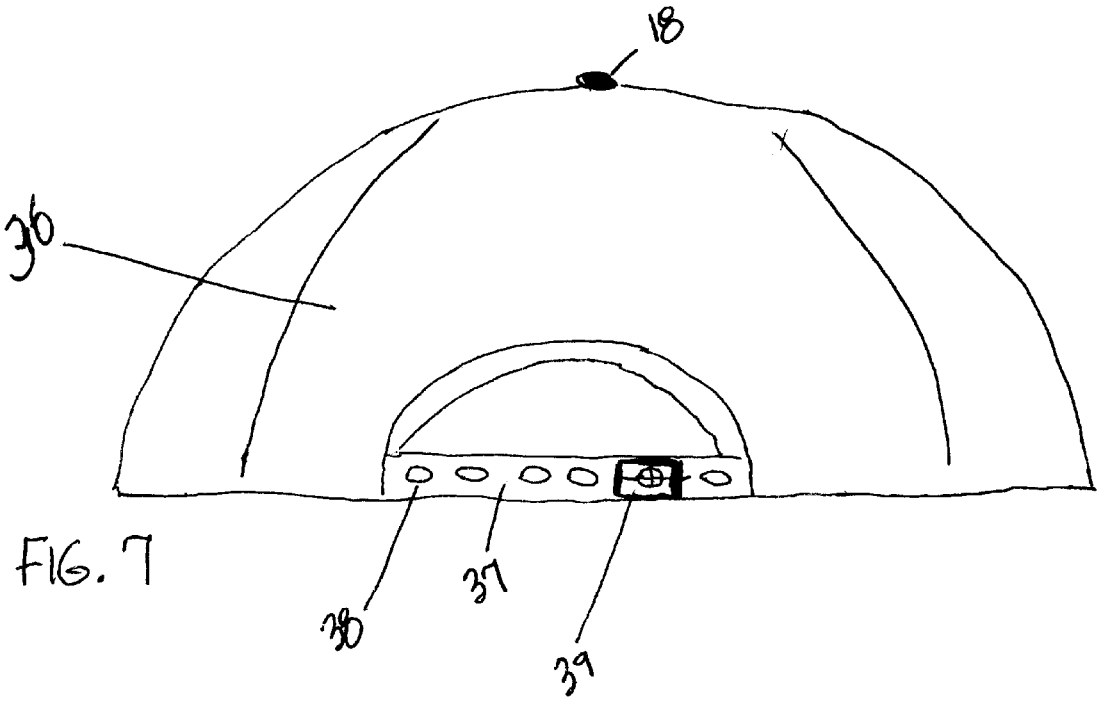
FIG. 7 depicts a rear view of a crown assembly with a prong buckle size adjustment mechanism.

As shown in FIGS. 4–6, an alternate of the preferred embodiment utilizes a detachable and reversible dual visor assembly 32 and 33 and also resembles a baseball-style cap. This headwear assembly includes a reversible crown 10 and 11 and a detachable, reversible dual visor 32 and 33. Visor 32 consists of longer and wider traditional look visor, which is located underneath visor 33, which is a shorter, not as wide visor. Visor 32 and visor 33 are sewn together at the flange, allowing for visor 32 to be flipped upwards, if desired (see FIG. 6). Similarly to the preferred embodiment, a male-female mechanism of detaching the visor from the crown and subsequent reattachment of the visor to the crown is utilized, also allowing for the reversal of the crown and or visor assemblies. Visor 32 and visor 33 both have two major opposing surfaces which includes different fabric colors or insignias.

Figure 8:
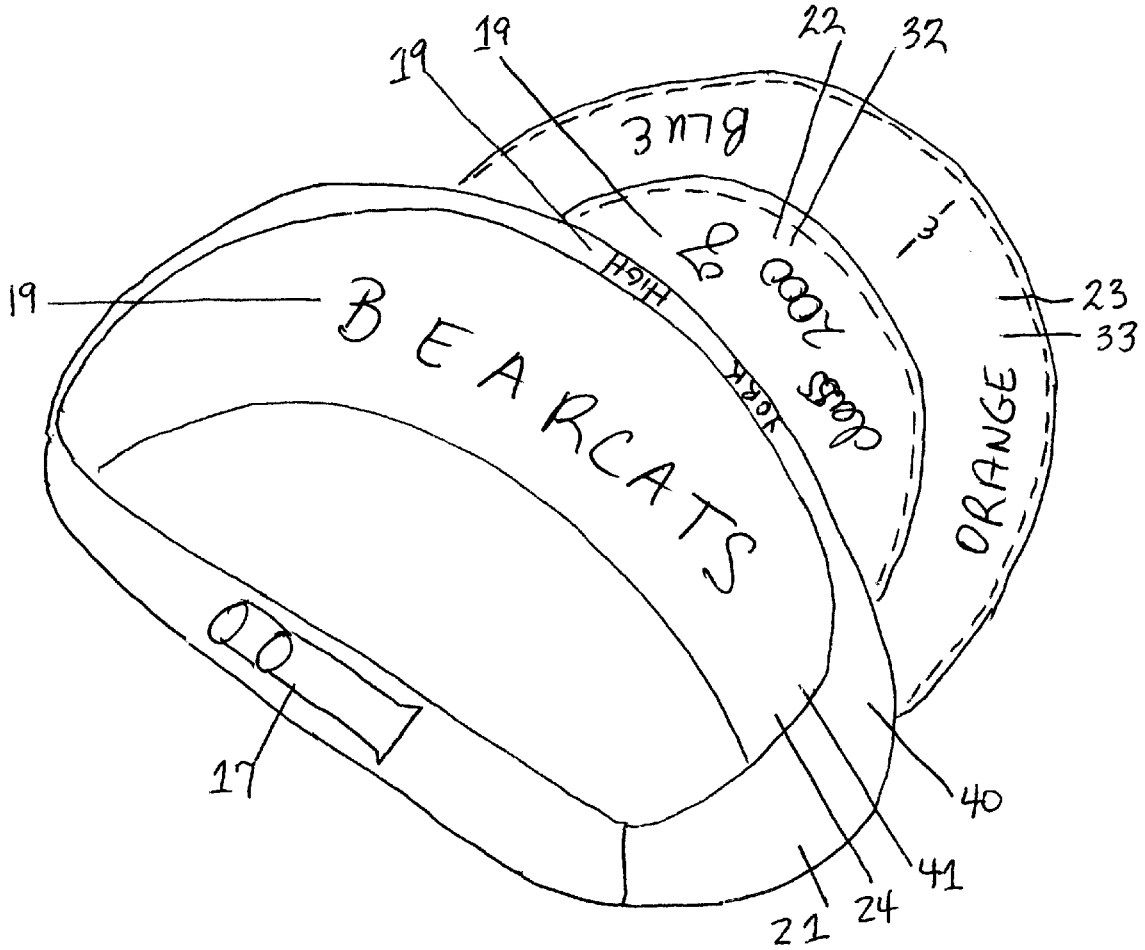
FIG. 8 is one wearable version, different from FIG. 1, which depicts a top, rear version of a sunvisor with a dual visor.
Figure 9:
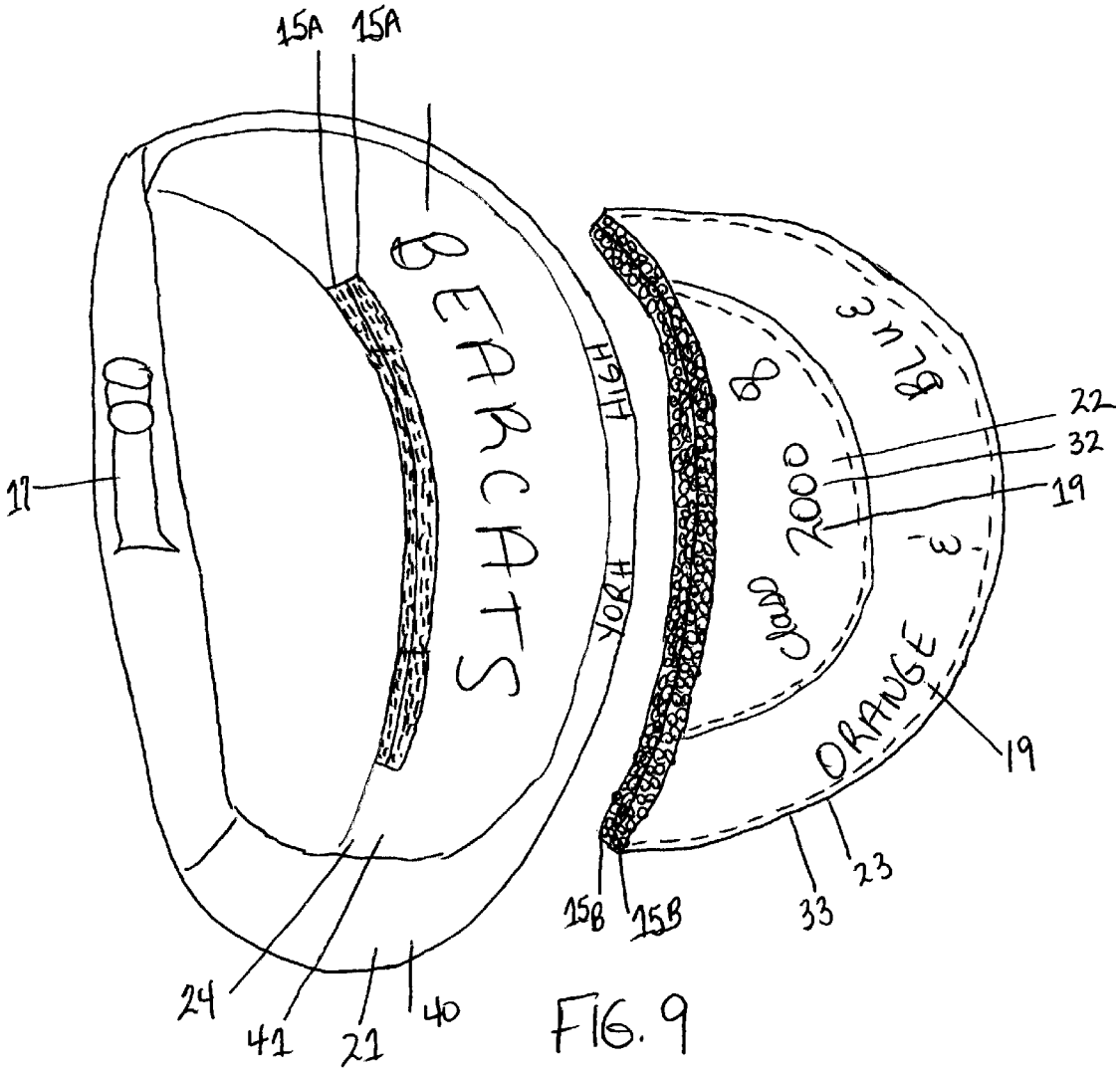
FIG. 9 is a view depicting how the dual visor connects to the crown of the sunvisor, where the exposed dual visor and unexposed dual visor both have hidden hook and loop attachments and are connected to the exposed crown of the sunvisor and unexposed crown of the sunvisor with hidden hook and loop attachments, according to the preferred embodiment of the present invention.

A second embodiment of the headwear assembly is illustrated in FIGS. 8–9. Reversible sunvisor crown assembly 40 and 41 is attached to the detachable and reversible dual visor 32 and 33. A male-female mechanism of detaching the visor from the crown and subsequent reattachment of the visor to the crown is utilized, also allowing for the reversal of the crown and or visor assemblies. The crown has two major opposing surfaces 40 and 41, which includes different fabric colors or insignias. The dual visor also has two major opposing surfaces 32 and 33, which allow for different fabric colors or insignias.

A third embodiment of the headwear assembly is illustrated in FIG. 10. Reversible kerchief crown assembly 50 and 51 is attached to the detachable and reversible single visor 13 and 14. A male-female mechanism of detaching the visor from the crown and subsequent reattachment of the visor to the crown is utilized, also allowing for the reversal of the crown and or visor assemblies. The crown has two major opposing surfaces 50 and 51, which includes different fabric colors or insignias. The single visor also has two major opposing surfaces 13 and 14, which allow for different fabric colors or insignias.

A headwear assembly with a reversible crown and detachable and reversible visor is described above. Various details of the invention may be changed without departing from its scope. Furthemore, the foregoing description of the preferred embodiment of the invention is provided for the purpose of illustration only and not for the purpose of limitation-the invention being defined by the claims and their legal equivalents.

CONCLUSION

This invention relates to a headwear assembly with two major crown surfaces that can be reversed, with a single or dual visor with two major surfaces that can also be reversed. The invention creates a possibility of obtaining multiple looks out of this single creation. There are two crown sides and two visor sides, which can be utilized. The first crown side can be worn with the first or second visor side, and the second crown side can be worn with the first or second visor side. The invention can be flipped to expose the any side of the cap the wearer wishes to become prominent. The invention can also be worn to display multiple colors, fabrics or insignias on either of the two sides of the crown or either of the two sides of the single or dual visor. The exposed and non-exposed crowns, along with the exposed and non-exposed visors can be made up of different colors, fabrics or insignias, thus creating multiple looks with one product Insignias can be a logo, advertisement, sports team emblem or the like. The mechanisms utilized for reversing and attaching the crown and visor can be hook and loop fasteners, snaps or other attachment assemblies and are hidden from plain view.

The present invention overcomes limitations of prior caps by providing additional space for being creative with colors, fabrics or insignias, as well as providing the wearer with several display options for fashion or insignia advertisement, while maintaining the general appearance of a conventional headwear garment.

I claim:

1. A reversible headwear assembly comprising:

a visor and a dome-shaped crown;

said visor having upper and lower portions and front and rear portions with a flange attached to the rear portion; the flange having inner and outer surfaces, each surface including attachment means for selective attachment to said crown;

said crown having a two-ply construction with an inside portion and an outside portion, a top portion, a front portion, a rear portion, an opening for receiving the head of a wearer, a bottom edge along said opening, and means for releasably attaching said crown at its front portion, to the flange of the visor, wherein the visor is disposed between said plies, with the remaining bottom edges permanently secured together;

whereby the wearer can separate the crown from the visor, invert the crown portion so that the inside portion becomes the outside portion, and re-attach the visor, wherein the visor portion is reversible.

2. A reversible headwear assembly according to claim 1, wherein the means is one of hook and loop and snap fasteners.

3. A reversible headwear assembly according to claim 1, wherein the inside and outside crown portions include embellishments selected from the group consisting of: insignias, logos, and sports team emblems.

4. A reversible headwear assembly according to claim 1, wherein the upper and lower visor portions include embellishments selected from the group consisting of: insignias, logos, and sports team emblems.

5. A reversible headwear assembly comprising:

a visor and a triangular kerchief head covering;

said visor having upper and lower portions and front and rear portions with a flange attached to the rear portion; the flange having inner and outer surfaces, each surface including attachment means for selective attachment to said kerchief;

said kerchief having a two-ply construction with an inside portion and an outside portion, a top portion, a front portion, a rear portion, an opening for receiving the head of a wearer, a bottom edge along said opening, and means for releasably attaching said kerchief at its front portion, to the flange of the visor, wherein the visor is disposed between said plies, with the remaining bottom edges permanently secured together;

whereby the wearer can separate the kerchief from the visor, invert the kerchief so that the inside portion becomes the outside portion, and re-attach the visor, wherein the visor portion is reversible.

6. A reversible headwear assembly according to claim 5, wherein the means is one of hook and loop and snap fasteners.

7. A reversible headwear assembly according to claim 5, wherein the inside and outside portions of said kerchief include embellishments selected from the group consisting of: insignias, logos, and sports team emblems.

8. A reversible headwear assembly according to claim 5, wherein the upper and lower visor portions include embellishments selected from the group consisting of: insignias, logos, and sports team emblems.

* * * * *